United States Patent [19]

Cohan

[11] Patent Number: 4,781,112

[45] Date of Patent: Nov. 1, 1988

[54] APPARATUS FOR PRINTING HOLLOW CONTAINERS

[75] Inventor: Alvin M. Cohan, Englewood, N.J.

[73] Assignee: American Production Machine Company, Union City, N.J.

[21] Appl. No.: 45,281

[22] Filed: May 4, 1987

[51] Int. Cl.[4] ..... B41F 17/26

[52] U.S. Cl. ..... 101/38 A

[58] Field of Search ..... 101/40, 30, 38 R, 38 A

[56] References Cited

U.S. PATENT DOCUMENTS

| | | | |
|---|---|---|---|
| 3,019,725 | 2/1962 | Freeman | 101/38 R |
| 3,083,636 | 4/1963 | Carkhuff | 101/37 |
| 3,267,842 | 8/1966 | Resnick et al. | 101/40 |
| 3,388,686 | 6/1968 | Cohan | 101/40 X |
| 3,682,296 | 8/1972 | Buhayar et al. | 101/40 X |
| 3,685,441 | 8/1972 | Aebersold et al. | 101/38 A |
| 3,962,970 | 6/1976 | Tielrooy | 101/38 A |
| 3,996,851 | 12/1976 | Urban | 101/40 |
| 4,671,093 | 6/1977 | Dominico et al. | 101/38 A X |

FOREIGN PATENT DOCUMENTS

| | | | |
|---|---|---|---|
| 2341516 | 2/1975 | Fed. Rep. of Germany | 101/40 |
| 1099288 | 3/1955 | France | 101/38 R |
| 66429 | 4/1984 | Japan | 101/38 A |
| 8303402 | 5/1985 | Netherlands | 101/38 R |
| 1280037 | 7/1972 | United Kingdom | 101/40 |

*Primary Examiner*—Clifford D. Crowder

*Attorney, Agent, or Firm*—Stoll, Wilkie, Previto & Hoffman

[57] ABSTRACT

Apparatus for printing or decorating containers including generally rectangular containers with labels or other decoration and for operating at high speeds using two or more in-feeding lines of the containers. The containers are supported on rotatable holders as they are engaged by moving printing blankets of a multicolor printer with the preferred multiple feed lines and printing structures providing a significant increase in printing speeds.

9 Claims, 16 Drawing Sheets

PRINTING
PRINTING
1
2
11
41
18
19
16
9

7
8
11
1
6
13
30
25
4
11
1
5
1
2
17
18

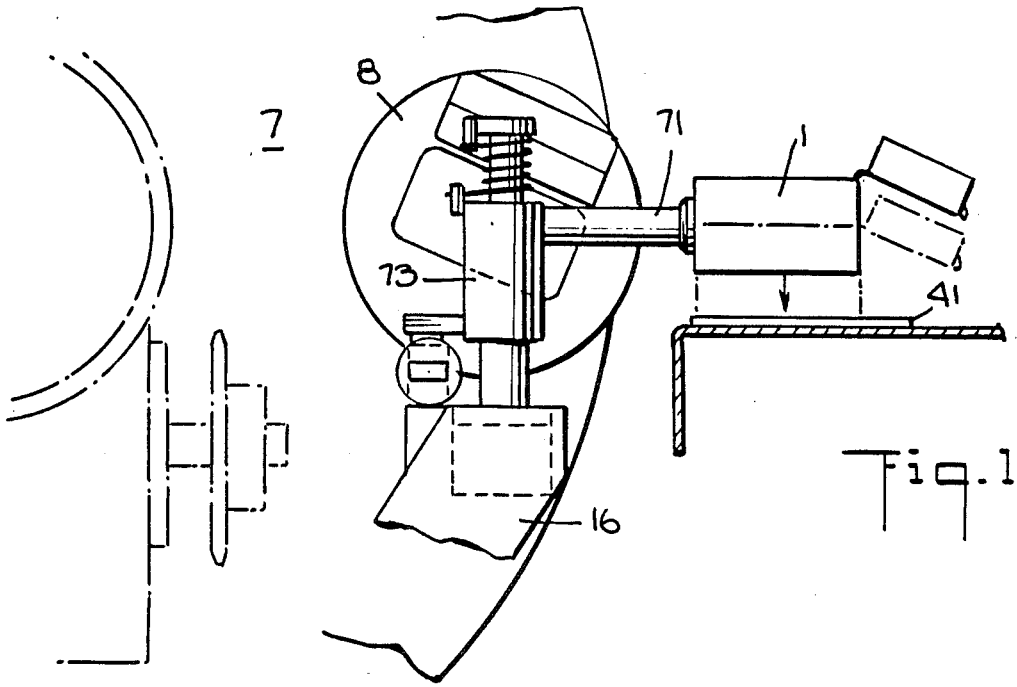
Fig. 16.
Fig. 17.
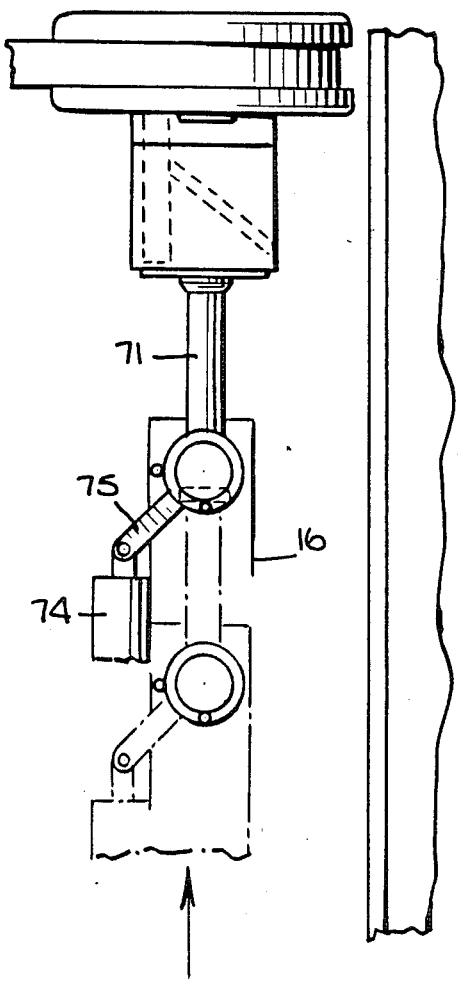
Fig. 18.
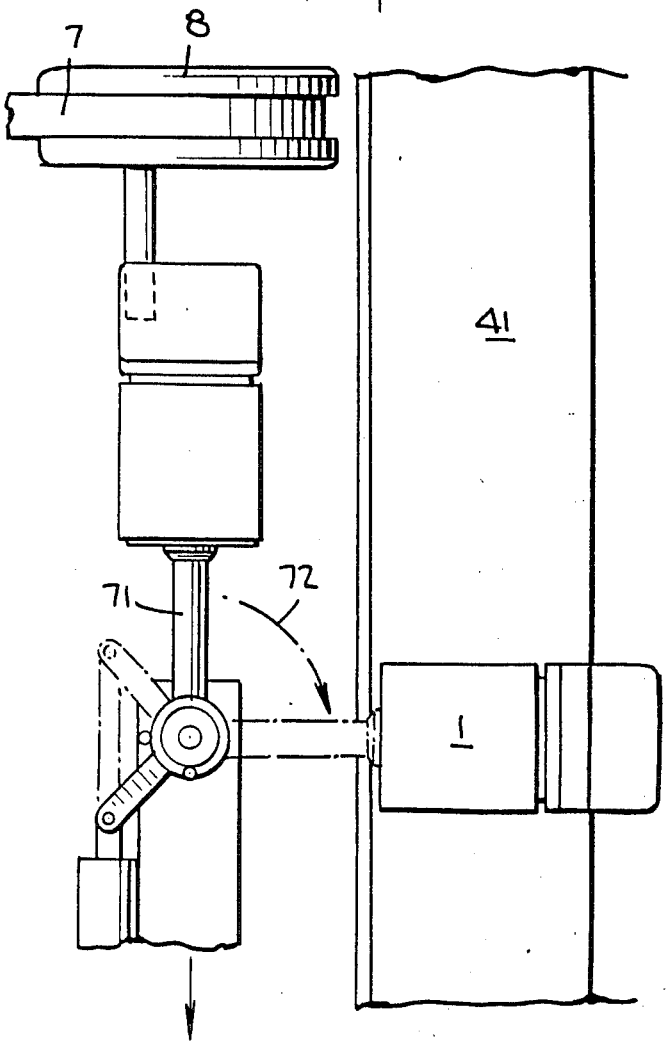

APPARATUS FOR PRINTING HOLLOW CONTAINERS

BACKGROUND OF THE INVENTION

The present invention relates to a method of and an apparatus for the high speed printing of labels or decoration on containers and container-like articles. More particularly, it relates to a high speed container printing operation adapted for rectangular containers or containers with flat surfaces and for the multicolored printing or decoration of such containers and high printed container output levels.

Various apparatus has been used for some time for automatically printing labels on containers in a number of colors and more especially for printing cylindrical or oval containers which have not been characterized by having sharp corners. The apparatus of the present invention is useful not only for the high speed multicolored container printing but for handling containers such as box-like plastic containers and similar containers where the applied label or decoration extends around 90° or relatively sharp corners.

For this purpose, feed means is provided for infeeding at least two lines of undecorated containers and for printing labels or decoration on the container side surfaces as well as for separately applying a label or decoration to a hinged container cover. The apparatus automatically feeds the dual lines of containers into the printing mechanism where the printing and fixing of the decoration or label is automatically performed on the container bodies and where the containers may be finally passed in a continuing automatic operation to means for positioning and printing hinged container covers.

Accordingly, an object of the present invention is to automatically print plastic and other containers with labels or decorations where the containers may have rectangular cross sections and flat angularly aligned surfaces.

Another object of the present invention is to provide a high speed container printing method for generally rectangular containers and the like for printing relatively large containers.

Another object of the present invention is to provide a container printing method and means for applying labels to container side and cover surfaces in a continuous automatic operation.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specication, wherein:

FIG. 16 is a detailed front view illustrating the container off-feed station VIII.

FIGS. 17 and 18 are detailed top plan views illustrating a container being removed from a container holder at the off-feed station VIII and placed on the removal conveyor.

DESCRIPTION OF THE PREFERRED EMBODIMENT

Figure 1:
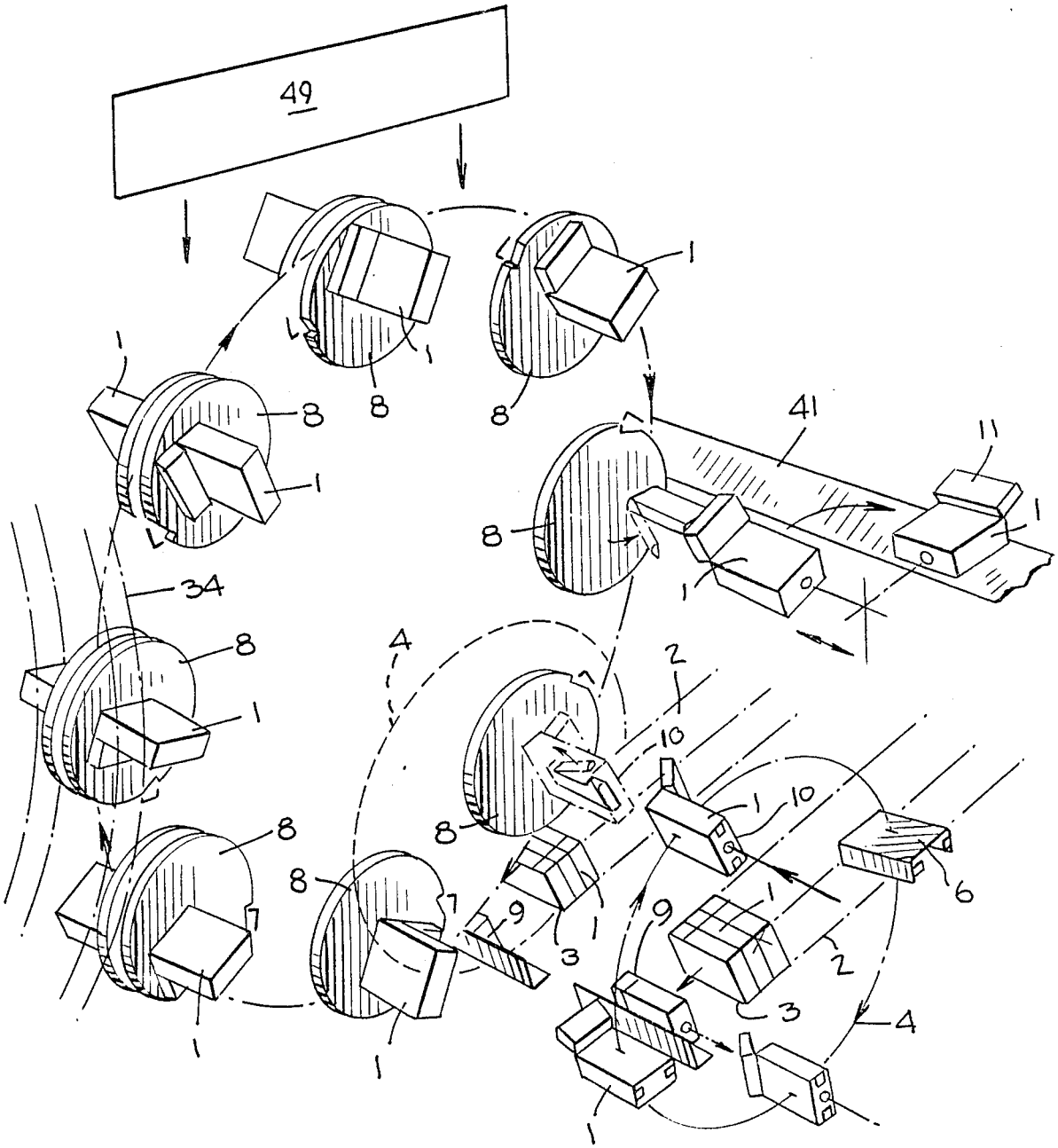
FIG. 1 is a diagrammatic perspective illustration of the apparatus and method.
Figures 2, 3:
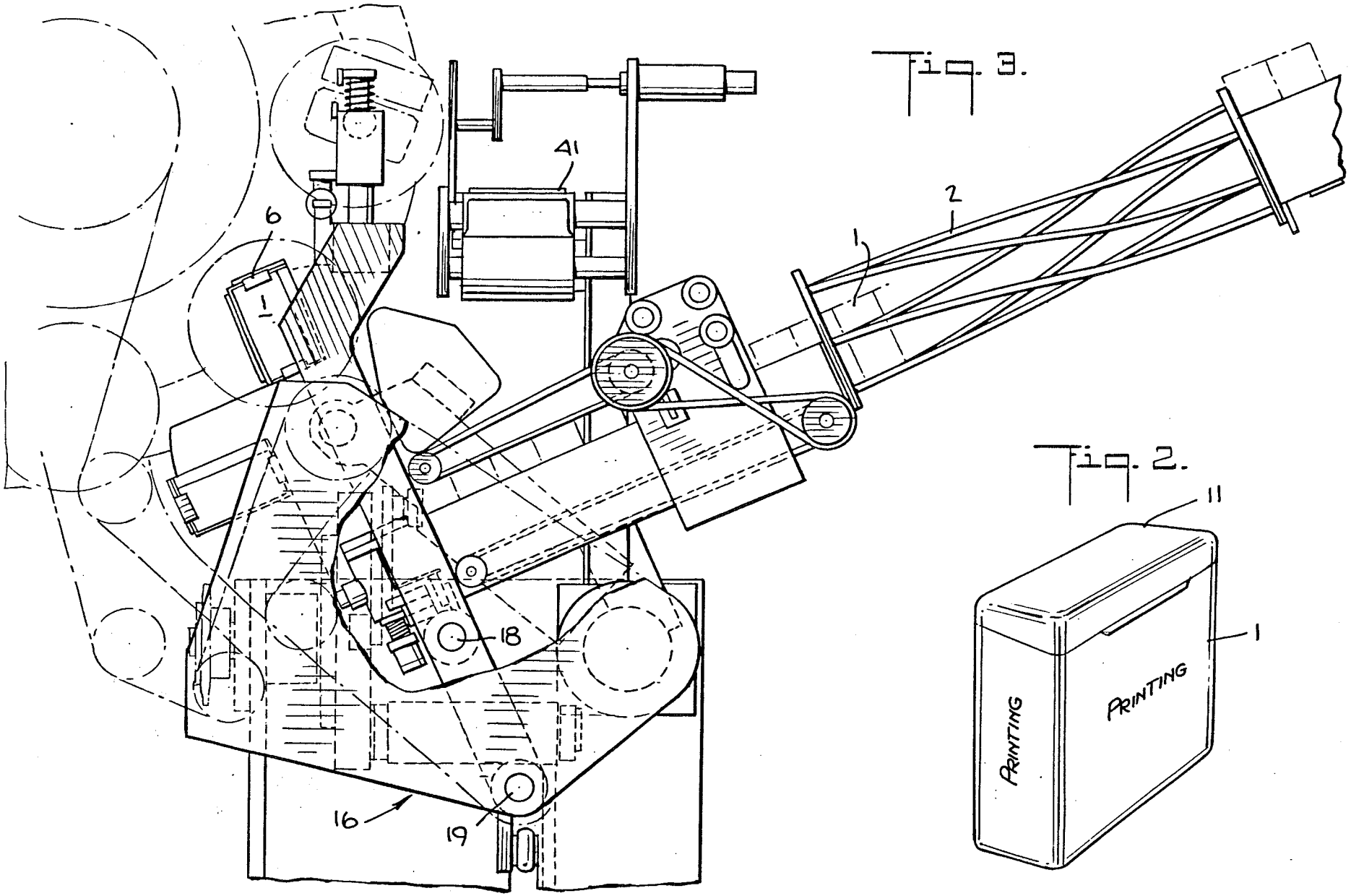
FIG. 2 is a perspective illustration of a typical container printed by the method and apparatus of FIG. 1.
FIG. 3 is a fragmentary front view of the printing apparatus.

FIG. 1 is a diagrammatic perspective illustration of the principal operations and stations of the printing machine. Parallel rows of containers 1 are fed to the machine by elongated feed chutes 2 loaded with supplies of containers 1 and feeding them towards transfer points 3 at a transfer wheel 4. At the transfer points 3, the endmost containers 1 are drawn by vacuum rods 5 (FIG. 4) from the chutes 2 into open ended transfer compartments 6 on the transfer wheels 4. The transfer wheels 4, through the interconnected machine drive system, are rotated in synchronism wiht an adjacent printing disc 7 which mounts eight container holders 8. The transfer wheels 4 step from the loading position 9 to a discharge position 10. With the lid 11 held in an open position at the position 10, a pusher rod 13 (FIG. 4) slides each container 1 from the transfer wheel 4 compartment 6 to a container holder 8 on the printing disc 7.

As described above, the container 1 from the feed chutes 2 are each be transferred to the transfer wheel 4 and then to a container holder 8 on the printing disc 7. The transfer wheel 4 operates together with rode 5 and 13 to perform this timed transfer. Each container holder 8 is periodically stepped on the disc 7 to move the containers 1 through a number of stations I–VIII as the transfer wheel 4 is rotated in synchronism with the printing disc 7 to provide the transfer from the feed chutes 2 to the container holders 8 on the printing disc 7.

The transfer wheel 4 are mounted for timed and stepped movement on a driven shaft 15 (FIG. 4) mechanically coupled to and synchronized with the disc 7 drive. Each advance of the printing disc 7 to move the containers 1 from station to station is accompanied by a synchronized rotation of the transfer wheel 4 from presenting a container 1 to a container holder 8 on the printing disc 7.

Figure 4:
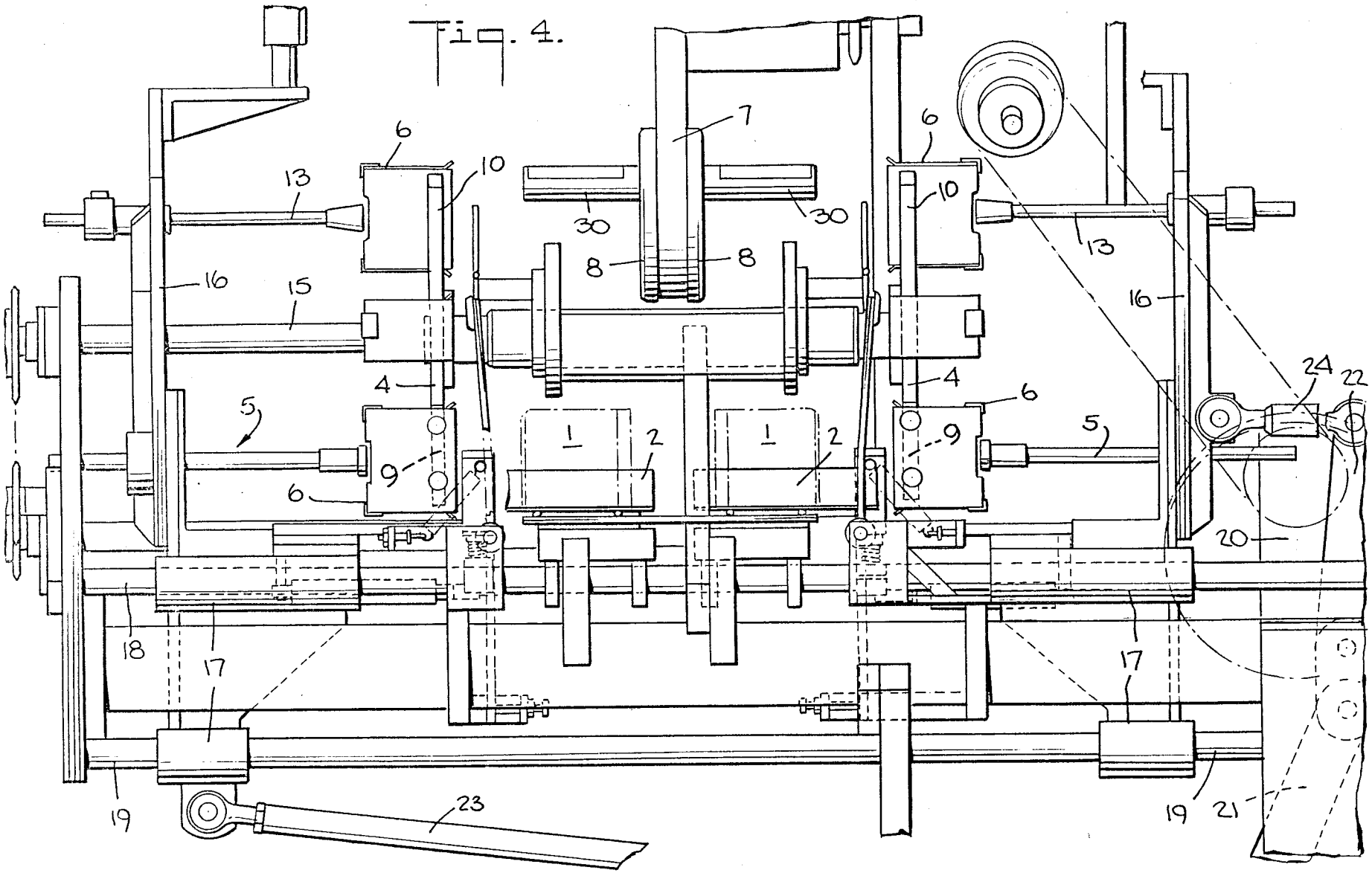
FIG. 4 is a side view of the printing apparatus.

FIG. 4 illustrates two container transfer means 16 which include the transfer rode 5 and 13 mounted for reciprocating movement on transfer bearings 17 moving on horizontal slide rods 18 and 19.

As illustrated in FIG. 4, the facing transfer means 16 are periodically moved through a container transferring cycle to move the endmost container 1 on each feed chute 2 first to a transfer compartment 6 on a transfer wheel 4 and thereafter from that compartment 6 on to a container holder 8 on the printing disc 7. The transfer means 16 are mechanically driven by means of two crank arms 20 and 21 pivotally attached to a rotating crank wheel 22. The outer end of the crank arm 20 is coupled to the left hand transfer means (FIG. 4) by a drive rod 23 and the right transfer means 16 is coupled by a second drive rod 24. The crank wheel 22 is positively coupled to the machine drive system for synchronized movement therewith and is adjusted to provide for the transfer of the containers 1 during a dwell period for the transfer wheels 4 and the printing disc 7.

Figure 6:
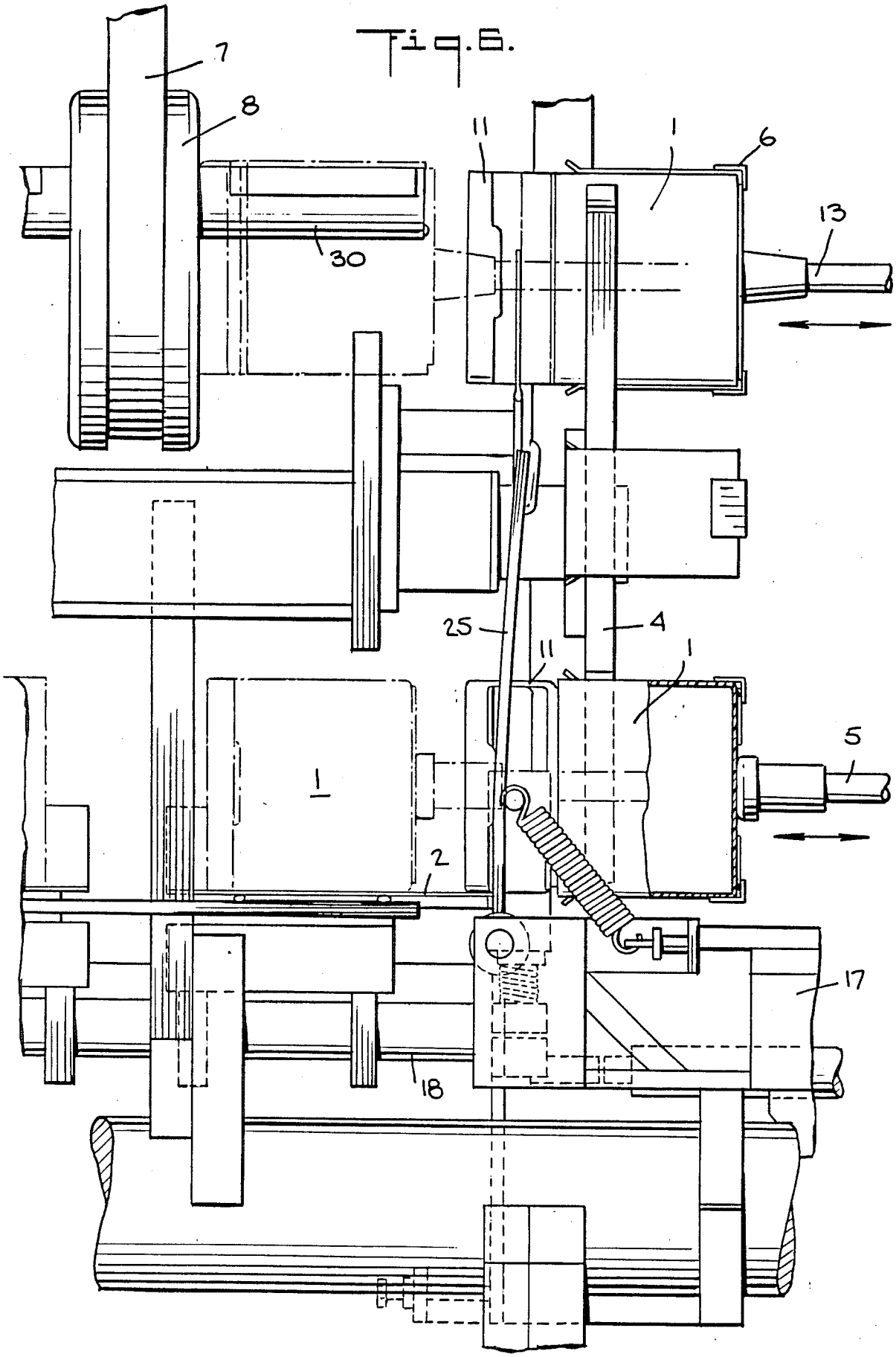
FIG. 6 is a fragmentary side elevational view illustrating the in-feed and dial loading apparatus.
Figure 7:
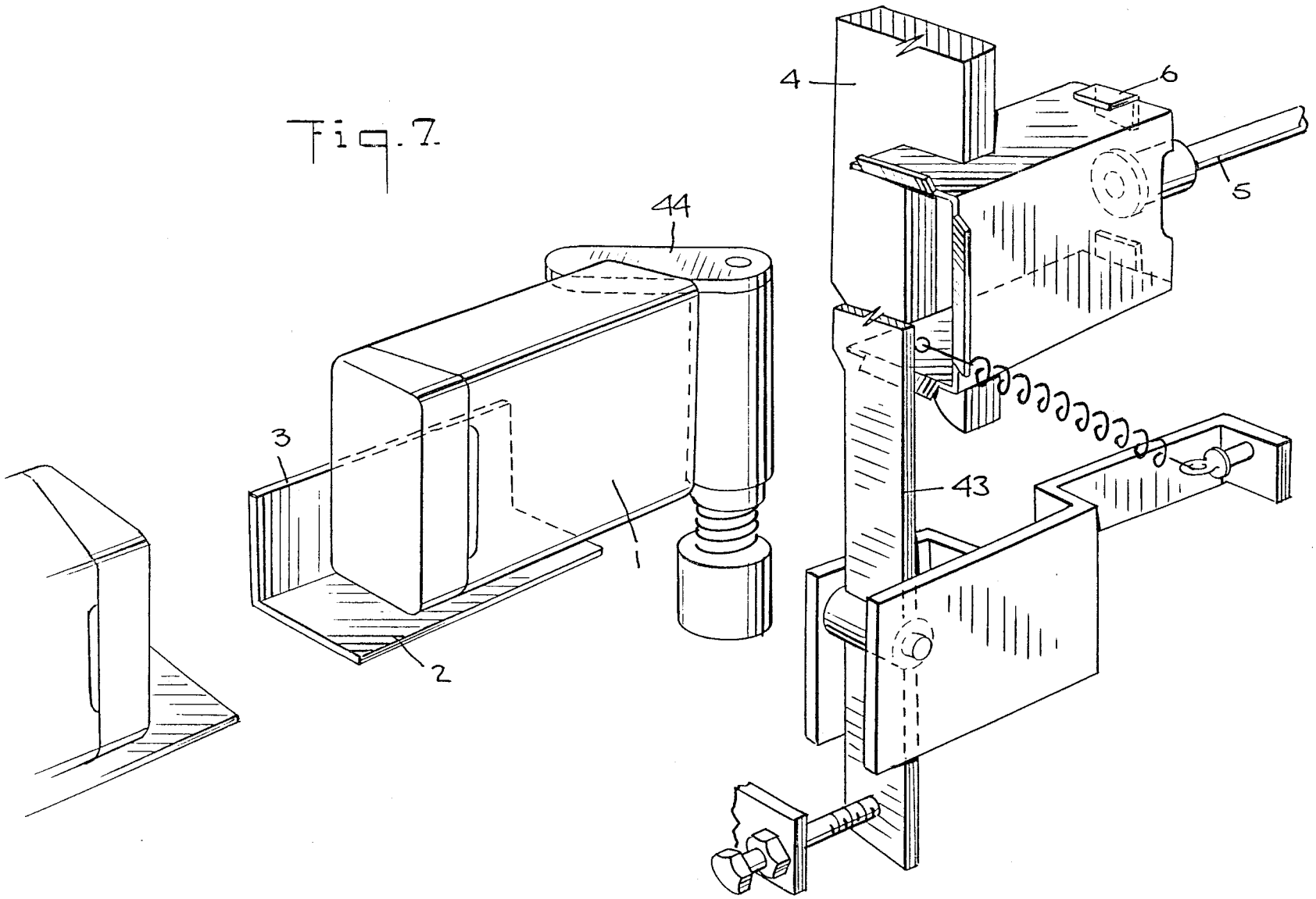
FIG. 7 is an enlarged detailed perspective view illustrating the container infeed and cover opening means.

FIG. 6 illustrates in greater detail the transfer of the containers 1. Thus, the vacuum rod 5 first is moved forward to draw the endmost container 1 from the feed chute 2 into the transfer compartment 6 on the transfer wheel 4 during a dwell period for the transfer wheel 4. After the transfer wheel 4 passes through a half turn, or two additional steps, the transfer compartment 6 aligns the container 1 with a container holder 8 on the printing disc 7. During the dwell period at this position, the push rod 13 moves the container 1 onto the container holder 8.

Figure 12:
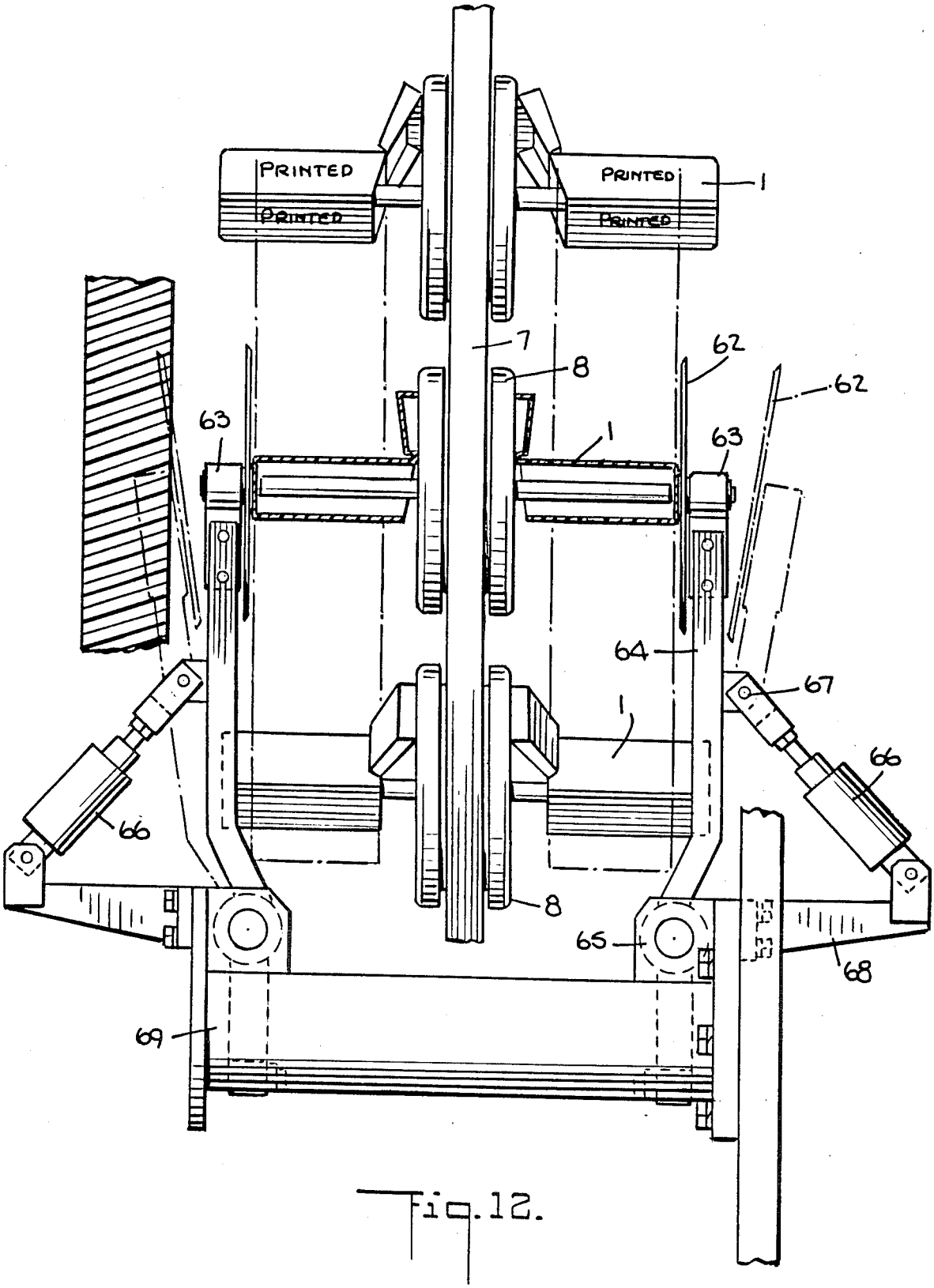
FIG. 12 is a detailed left side elevational view of the printing station.

As the container 1 is moved from the feed chute 2 into the transfer compartment 6, the cover opening cam means including an opening cam 43 and a pressure arm 44 causes the container lid 11 to be moved to an opened position. The lid 11 remains in this open position as the container 1 is moved on the transfer wheel 4 and while it is pushed onto the container holder 8 where the container 1 and the lid 11 are ready for the several decorating operations on the printing disc 7 with the relative lid 11 and container 1 positions as best illustrated at the center of FIG. 12.

As already indicated, the dual container 1 feed comprises the two generally parallel container feed chutes 2 with their infeeding ends 3 located adjacent to transfer wheels 4 as best illustrated in sectional view FIG. 4. FIG. 4 illustrates two containers 1 in dash dot lines as the endmost containers in the feed chutes 2. The transfer apparatus being reciprocated towards and away from the spaced transfer wheels 4 includes the two vacuum rods 5 and two push rods 13. During movement of the transfer apparatus 16 away from the two in-feed chutes 2, the vacuum rods 5 are advanced simultaneously into engagement with two containers 1 which are then pulled in opposite directions into feed compartments 6 in the two transfer wheels 4. During movement of the transfer apparatus toward the printing disc 7, the push rods 13 slide the containers 1 to the printing disc 7 holders 8.

Figure 8:
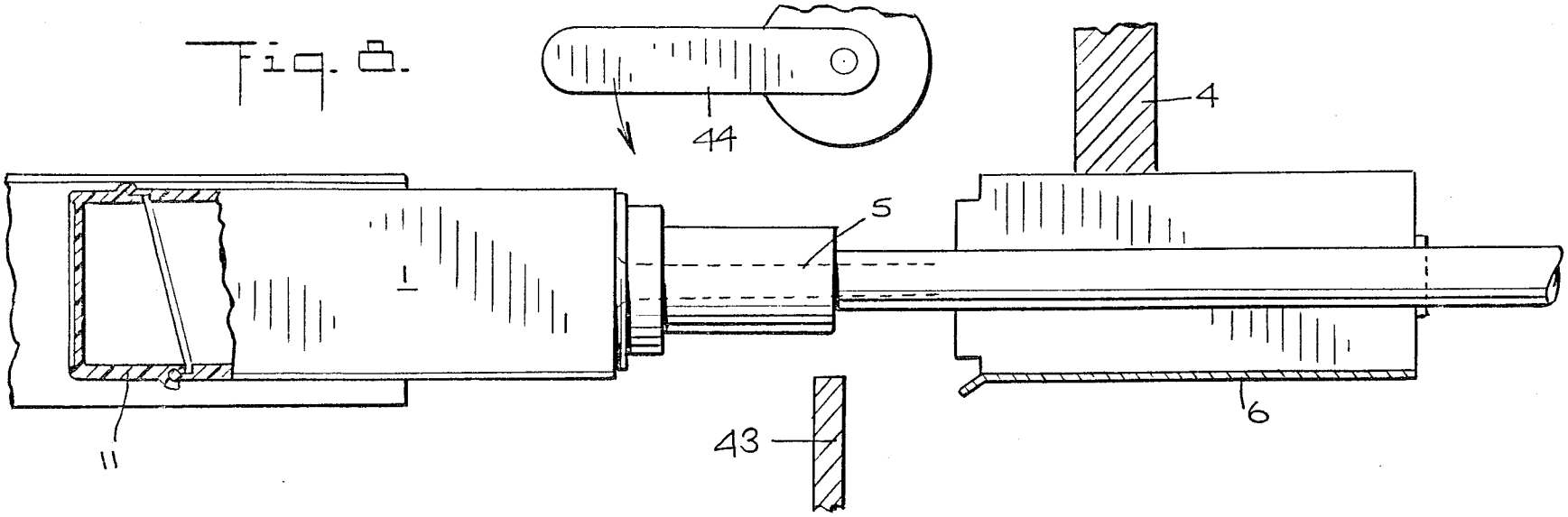
FIGS. 8 and 9 are enlarged top plan views of the container in-feed rod and cover opening mechanism.
Figure 9:
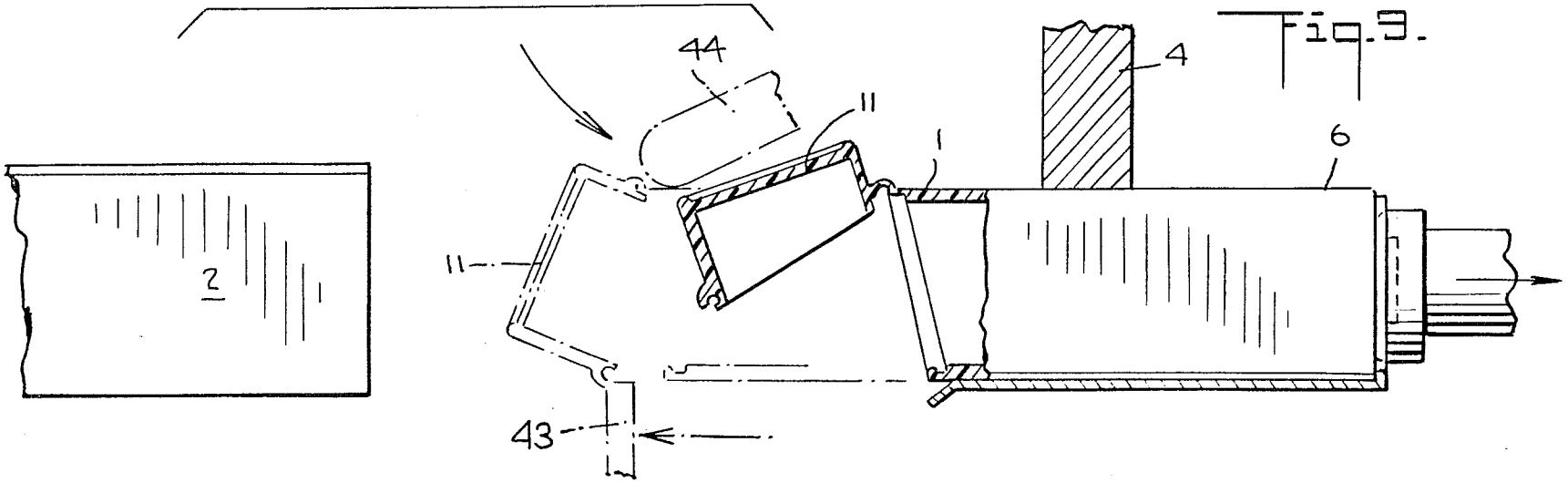

FIGS. 8 and 9 are enlarged top plan views of the transfer of containers 1 from the end of the container feed chutes 2 to the compartments 6 on the transfer wheels 4. The vacuum rod 5 is illustrated in FIG. 8 in engagement with a container 1 at the chute 2 end 3 and in the process of drawing this container 1 into the container holder 6 on the transfer wheel 4. During this movement the container lid 11 is opened by the interaction of the spring loaded pressure arm 44 operating on one side of the container 1 and the opening cam 43 positioned in the path of the container 1 for engaging and snapping the container lid 11 clear of the container 1 during its movement to the transfer wheel 4 as illustrated in dash-dot lines on FIG. 9.

THE PRINTING DISC

Figure 5:
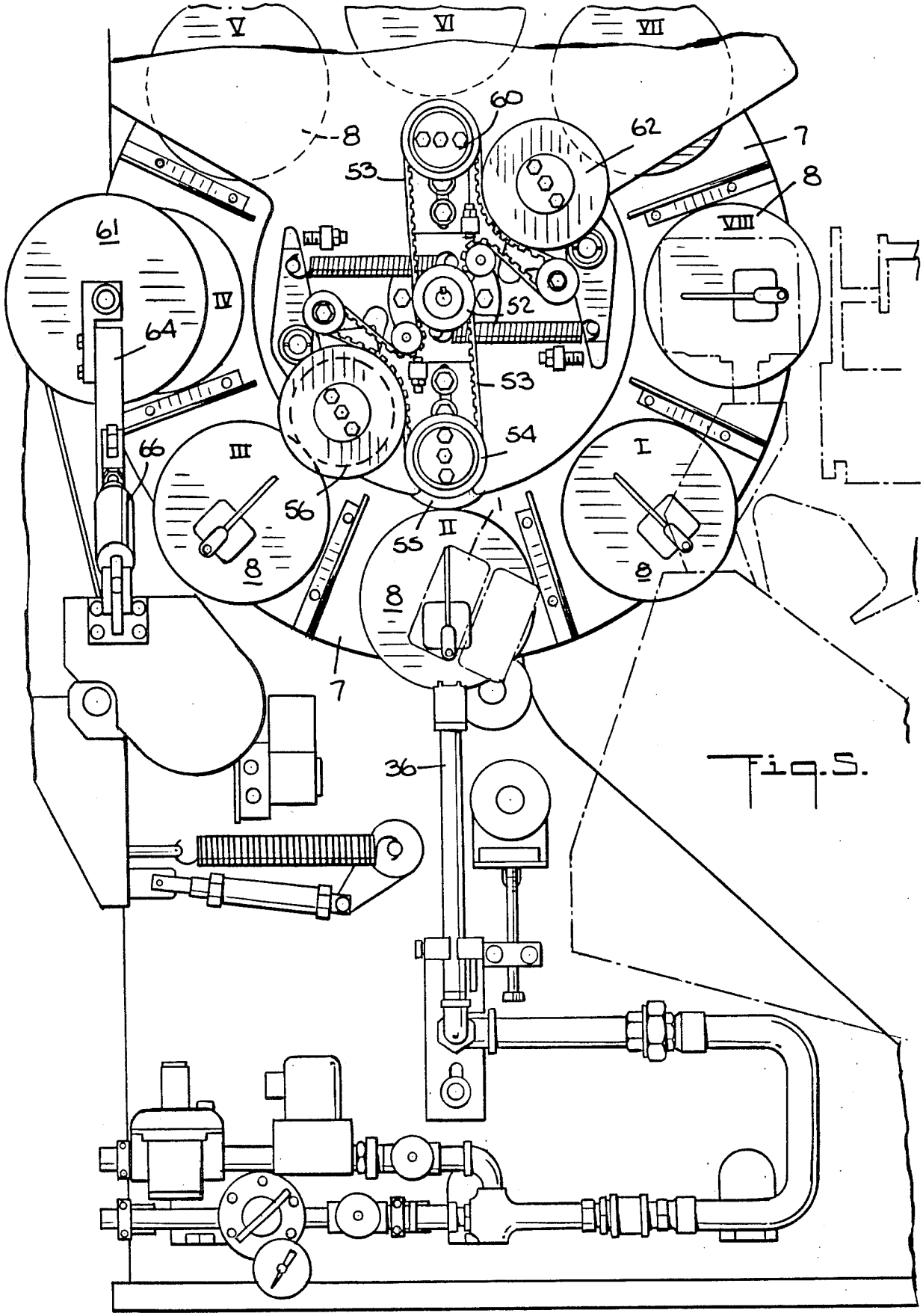
FIG. 5 is a front elevational view of the printing disc.

Each of the containers 1 to be printed are transferred to a separate container holder 8 on the printing disc 7 in the manner described above. The printing disc 7 as illustrated in FIG. 5, has eight separate container holders 8 mounted on each side of the periphery of the printing disc 7. The printing disc 7 is intermittently moved with a stepped rotation which periodically advances each of the container holders 8 to eight stations I–VIII where the several steps of the printing operation are performed. FIG. 5 illustrates eight container holders 8 on one surface of the printing disc 7 and there are eight corresponding container holders 8 mounted on the opposite side of the printing disc 7 to handle the dual container feed and the dual printing operation.

Figure 10:
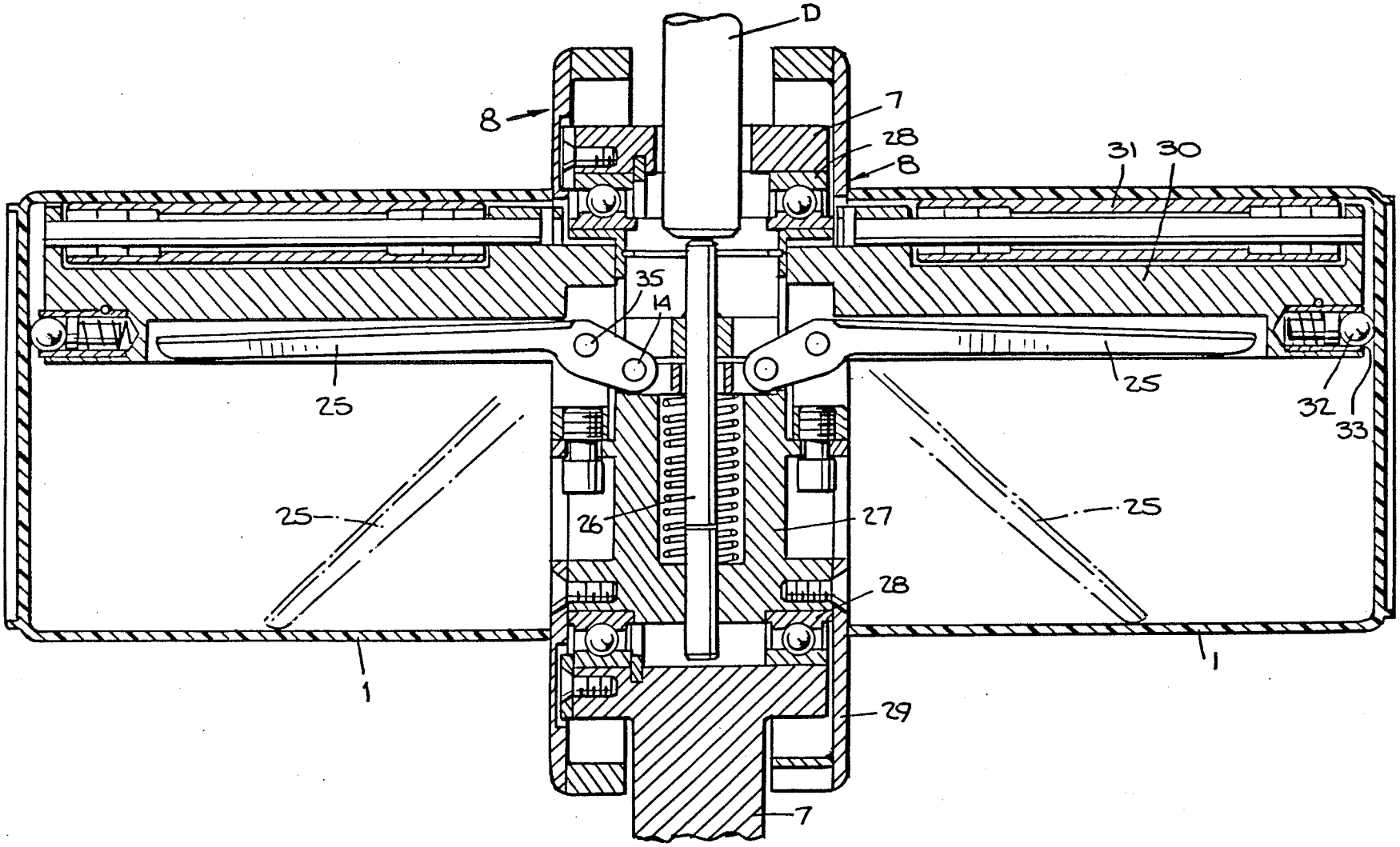
FIG. 10 is an enlarged sectional view illustrating the back-to-back container holders on the printing disc.

FIG. 10 is an enlarged detailed cross section of two container holders 8 mounted back to back on the rim of the printing disc 7. The container holders 8 are mounted on a hub 27 rotatably mounted on ball bearings 28. A hub cap 29 is attached to each end of the hub 27 as is also an outwardly extending roll support 30 mounting a container roller 31. At the outer end of each roll support 30 a spring loaded ball detent 32 is contained within a housing 33 for engaging each container 1 bottom. In order to hold each container 1 in position on a roll support 30, locking levers 25 are pivotally mounted at 35 on the hub 27. The locking levers 25 are urged to their container engaging position by a spring loaded plunger 26 positioned in the hub 27. The inner end of each locking lever 25 is pivotally attached at 14 to the plunger 26 illustrated in its disengaged position in solid lines and in its gripping position in dash-dot lines in FIG. 10. Movement of the plunger 26 outwardly of the printing disc 7 causes the locking levers 25 to move to the container engaging position. A suitable hydraulic cylinder or other drive D may be positioned adjacent to the edge of the printing disc 7 to move the locking levers 25 to their disengaged positions by forcing the plunger 26 inwardly of the printing disc 7 at stations where the locking levers 25 are to be disengaged from the containers 1. These may include the container 1 loading position I, the container off-loading position VIII and the printing Station IV. FIG. 10 illustrates a pair of the container holders 8. As illustrated in FIG. 5, there are eight container holders 8 on each surface of the printing disc 7 making a total of sixteen in the illustrated embodiment. During the printing operation at the printing station IV, the moving printing blanket 34 (FIG. 13) engages the surface of the containers 1 and causing the containers to move around the holders 8 on the rollers 31 presenting all container sidewalls to the printing blanket 34.

The several operating stations for the container holders 8 are designated as Stations I through VIII in FIGS. 1 and 5. Station I presents the container holders 8 to the similar but oppositely oriented transfer wheels 4 and the transfer rods 13 as described above. The mechanical drive of the transfer rods 13 is synchronized with the moving printing disc 7 drive by being all positively interconnected through chains, gears or interconnected drive shafts. During the loading by transfer rods 13, the locking levers 25 are swung to their disengaged position by the movement of a drive cylinder plunger 26 (FIG. 10).

The printing disc 7 is next stepped forward to move a container holder 8 to the Station II which is a heating position which presents the containers 1 on the two container heads 8 to heating flames 36 as the containers 1 are rotated by the operation of the container head drive system 37 (FIG. 5).

Figure 14:
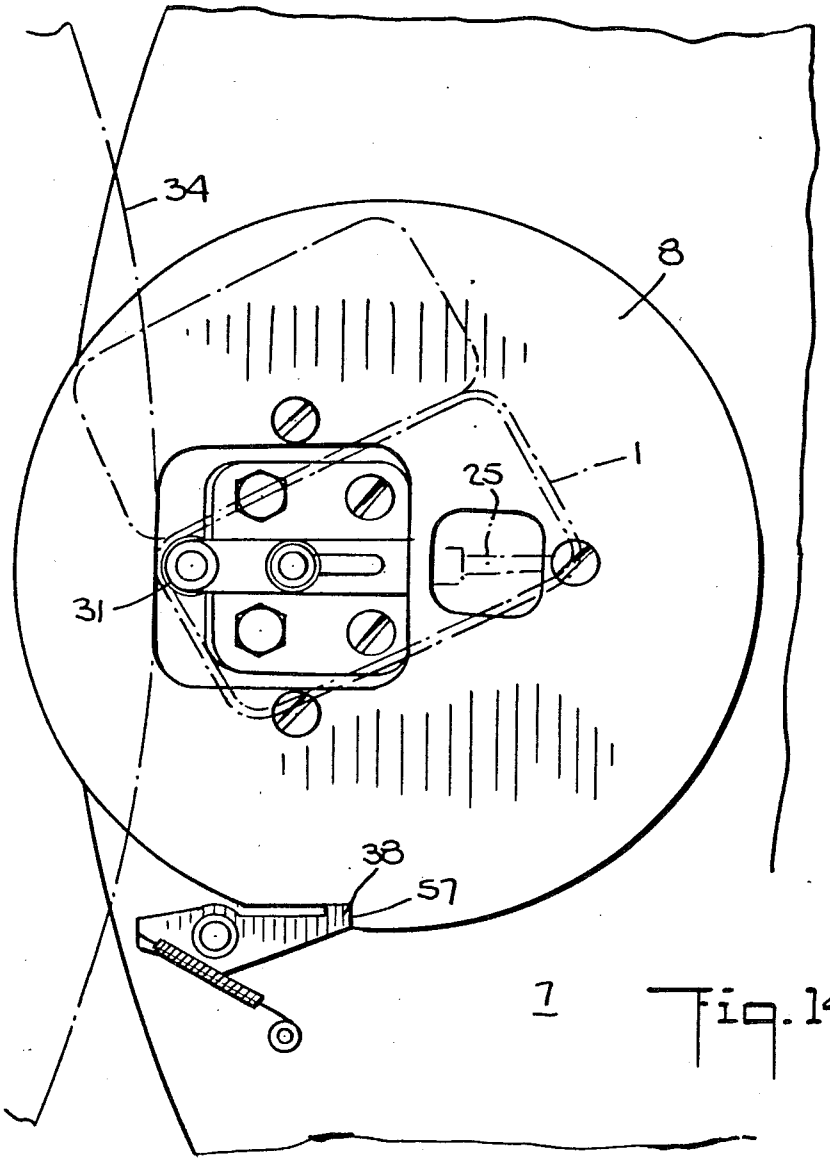

The container head drive system as illustrated at 37 in FIG. 5 is a continuously moving drive system in which portions engage the container holders 8 at certain stations to rotate the container holders 8 with their supported containers 1. A central drive gear 52 is operatively connected to the machine drive system for continual rotation during the operation of the printing machine. The gear 52 is operatively connected to several drive wheel means by an elongated endless drive chain 53. Thus, the chain 53 engages and rotates a drive means 54 at Station II whose outer edge 55 frictionally engages and rotates the two container holders 8 at this Station II for flame treatment as long as the printing disc 7 positions the container holders 8 at the Station II. A second rotatably mounted drive means 56 is also engaged and rotated by the chain 53. This drive means engages the two container holders 8 at an orientation Station III (FIG. 14). Here a latching tooth 38 on the printing disc 7 engages a suitable notch 57 and terminates the rotation of the container holders 8 at a desired orientation suitable for the commencement of the printing at the printing Station IV. The drive means 56 at Station III is an overridden drive which becomes ineffective as soon as the latch 38 terminates the rotation of the container holder 8. The latch 38 remains engaged at the printing Station IV (FIG. 15) as the printing blanket 34 engages the side walls of the container 1 being printed and rolls it around the roller 31. An additional drive means 60 at the U.V. curing station VI is also rotated by the endless chain 53 to rotate the printed containers 1 as the ultraviolet heating 49 fixes the printing on the containers 1. Finally, an additional overridden drive means 61 also engages the container holders 8 at a second orientation Station VII to locate the container holder 8 positions both at the discharge station and at the in-feed station. The latch 38 described above, is engaged and remained engaged until again disengaged for the flame treatment at Station II. The latch 38 is disengaged by a reverse rotation of the holders 8 provided by the positioning of the path of chain 53.

Figure 13:
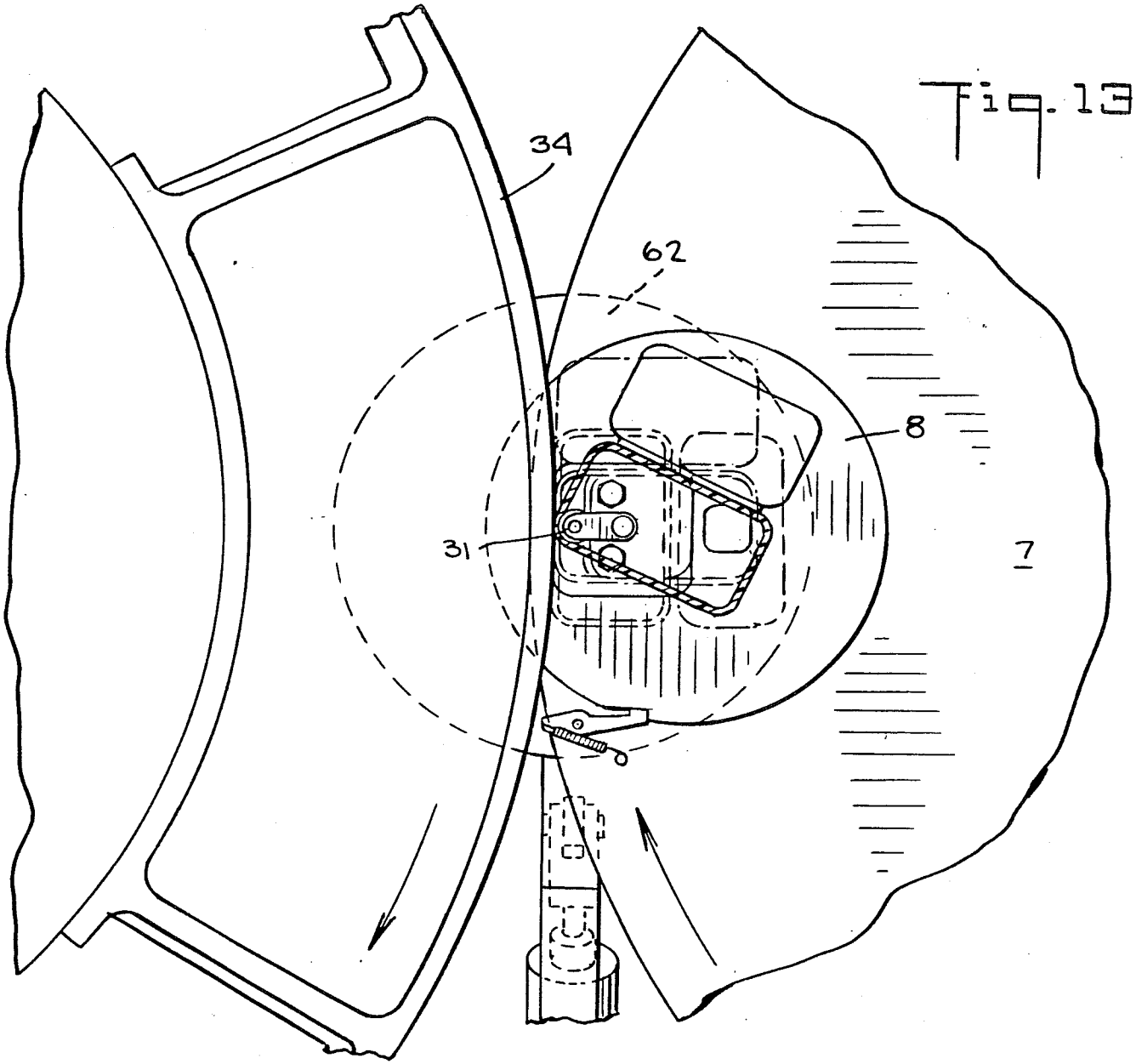
FIG. 13–15 are detailed front elevational views of the container printing station.
Figure 15:
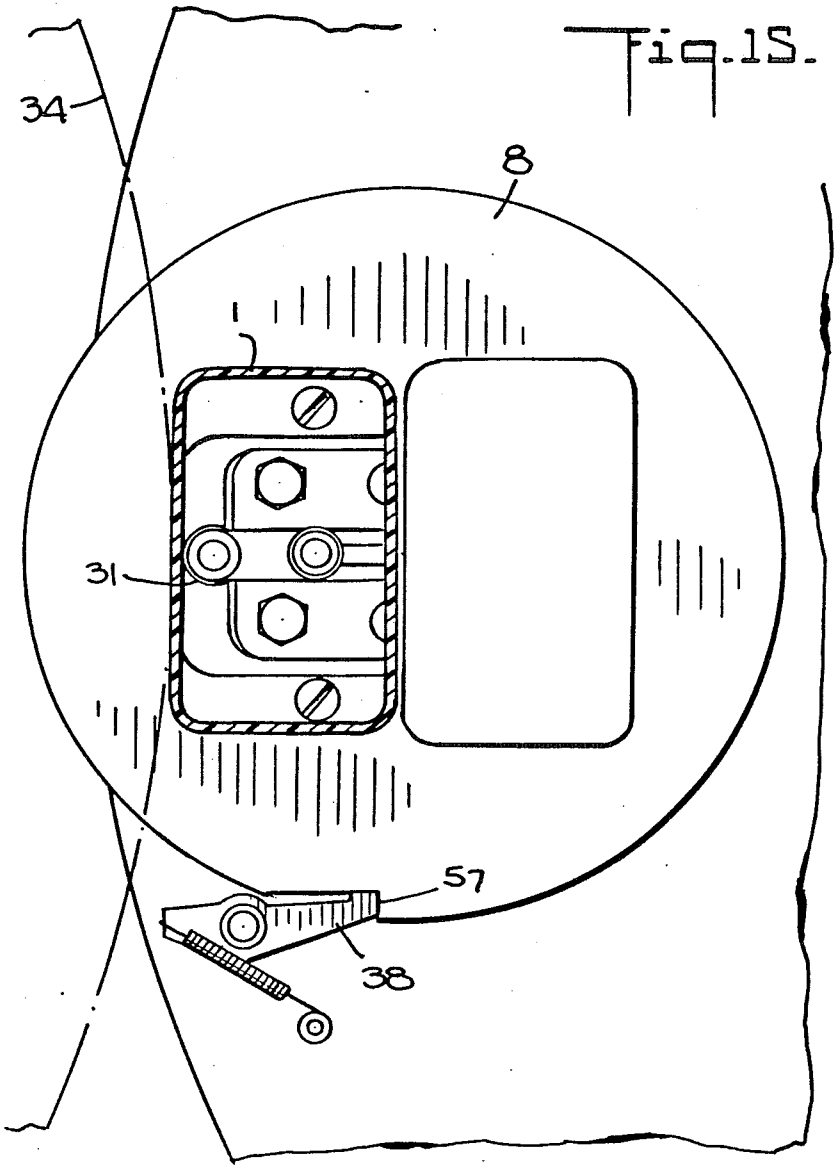

At Station IV each precisely positioned container 1 is presented to the printing blanket 34 which has been coated with the image to be transferred in the desired colors from the offset printing apparatus 40. This offset multicolor device is of known construction of the type which presents the printing blanket to the container 1 being labelled or decorated and rotates the container 1 by the frictional contact between the moving printing blanket 34 and the containers 1 as illustrated in FIGS. 13 and 15.

Figure 11:
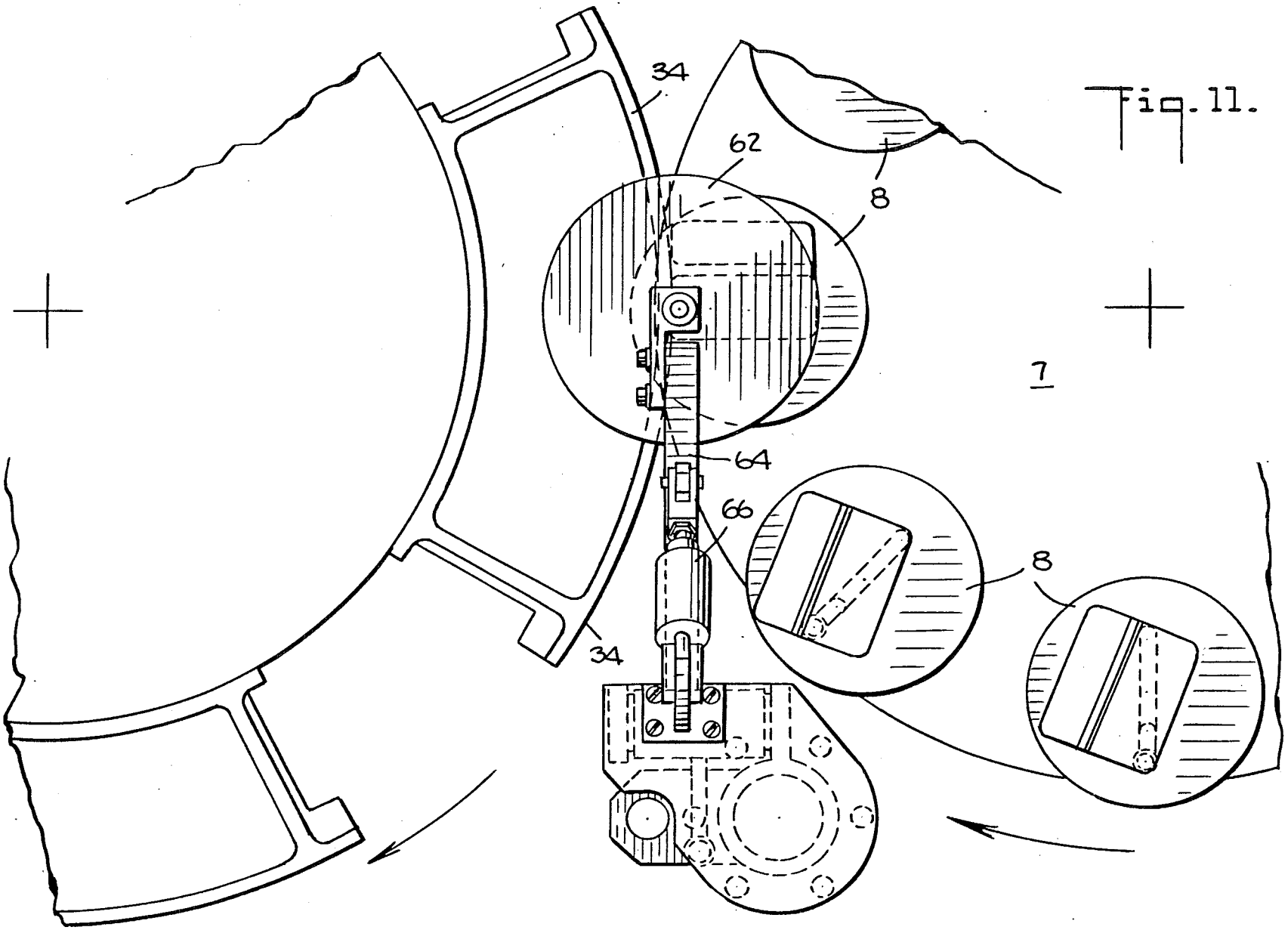
FIG. 11 is an enlarged detailed front view illustrating the printing station.

As already described, each container 1 is movably mounted on a container holder 8 so that it is rolled around a roller 31 on the container holder 8 by the moving printing blanket 34. In order to hold each container 1 in position on the roller 31, with its bottom against ball detent 32 (FIG. 10) on the container holder 8, an end plate 62 is moved into engagement with the container 1 during the printing cycle at the printing station IV. During the printing, the levers 25 are disengaged by a suitable air cylinder acting on the plunger 26 (FIG. 10). The plates 62 are illustrated in FIGS. 5, 11 and 12. Each of the two plates 62 is pivotally mounted on a bearing 63 at the upper end of a mounting rod 64. The mounting rods 64 are supported on bearings 65 attached to the machine base for movement toward and away from the path of the container holders 8 on the printing disc 7 and are moved between the dash-dot and the full line positions shown on FIG. 12. A drive cylinder 66 is connected between a hinge coupling 67 on the mounting rod 64 and a bracket 68 attached to the machine frame 69. Arrival of each pair of container holders 8 at the printing station IV activates a suitable switch device causing the drive cylinders 66 to move each of the plates 62 into its container 1 engaging position and the initial movement of the printing disc 7 to carry the printed containers away from the printing station causes the drive cylinders 66 to withdraw the plates 62.

The printed containers 1 are now advanced by the printing disc 7 thru Station V to Station VI where the printed containers 1 are subjected to ultraviolet heating 49 (FIG. 1) by known UV heating to fix the decorations or labels on the containers 1. At these stations the orienting latch 38 remains removed permitting the containers 1 to be rotated by the drive system chain system as described above.

Station VII activates the single tooth latch 38 which is again moved into engagement with the container holders 8 and orients the printed and dried containers 1 for transfer at Station VIII to the removal conveyor 41 (FIG. 16–18).

OFF-FEED FROM THE PRINTING DISC TO THE OFF FEED CONVEYOR

When the printing disc 7 carries a pair of container holders 8 to Station VIII, the two containers 1 have had their body portions suitably printed or labeled and are dried or cured and are ready for discharge to the off-feed conveyor 41. At the off-feed station VIII, suction rods 71 are used to simultaneously withdraw the containers 1 from the back-to-back container holders 8. The suction rod bar 71 is mounted on the same reciprocating carriage 16 described above in connection with the description of the in-feed wheel 4 and the rod means 5 for transferring the containers 1 from the ends of the two container feed chutes 2 to the transfer wheel 4 and to the printing disc 7 at Station I. Thus, at the same time that the interconnected pull and push rods 5 and 13 are transferring the containers 1 at Station I, a pair of vacuum operated suction rods 71 engage and withdraw printed containers 1 from the printing heads 8 at Station VIII.

FIG. 17 illustrates the beginning of the withdrawal of a package 1 from one of the container holders 8 and FIG. 18 illustrates the completion of the withdrawal movement moving the package 1 generally clear of the container holder 8. Since the removal conveyor 41 has a path at right angles to the printing disc 7, it is necessary to turn the withdrawn containers 1 through the 90° angle illustrated at 72 in FIG. 18 to place the printed container 1 on the moving conveyor 41. This is accomplished by the pivotal mounting 73 for the suction rod 71 pivotally mounted on the end bracket 16 and operated by a suitable timing means through the intermediation of the drive cylinder 74 by the crank 75. The vertical view of FIG. 16 illustrates the mounting for the pivot 73 and the drive cylinder 74 and the crank 75. Removal of the vacuum permits the decorated container 1 to drop onto the conveyor 41 with the package cover 11 in the open position as illustrated. A printing means (not shown) may apply the desired label or decoration to the lid 11.

Figure 19:
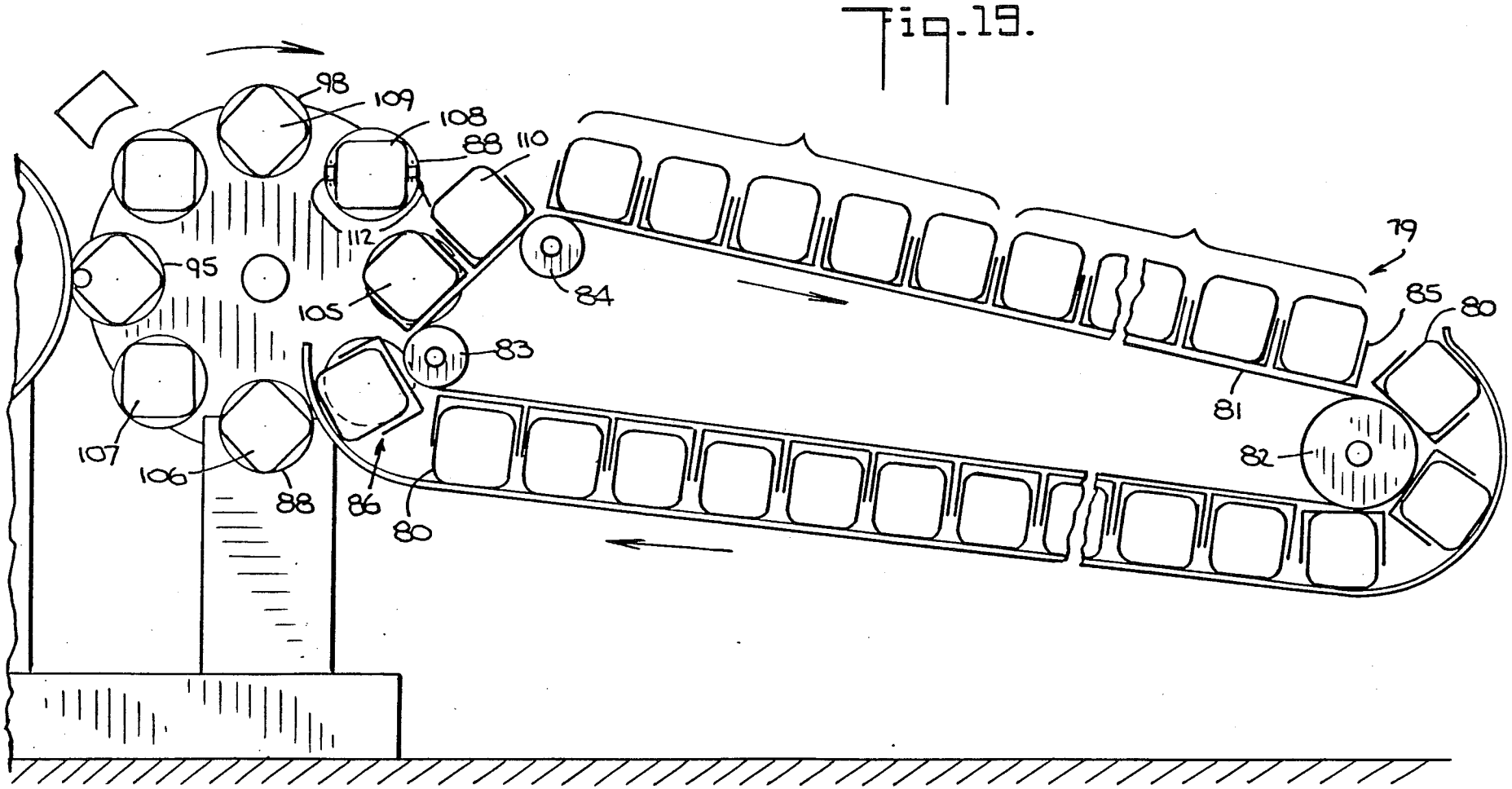
FIG. 19 is a diagrammatic front view of another embodiment of the apparatus illustrating the differing infeed for larger tub-like containers.
Figure 20:
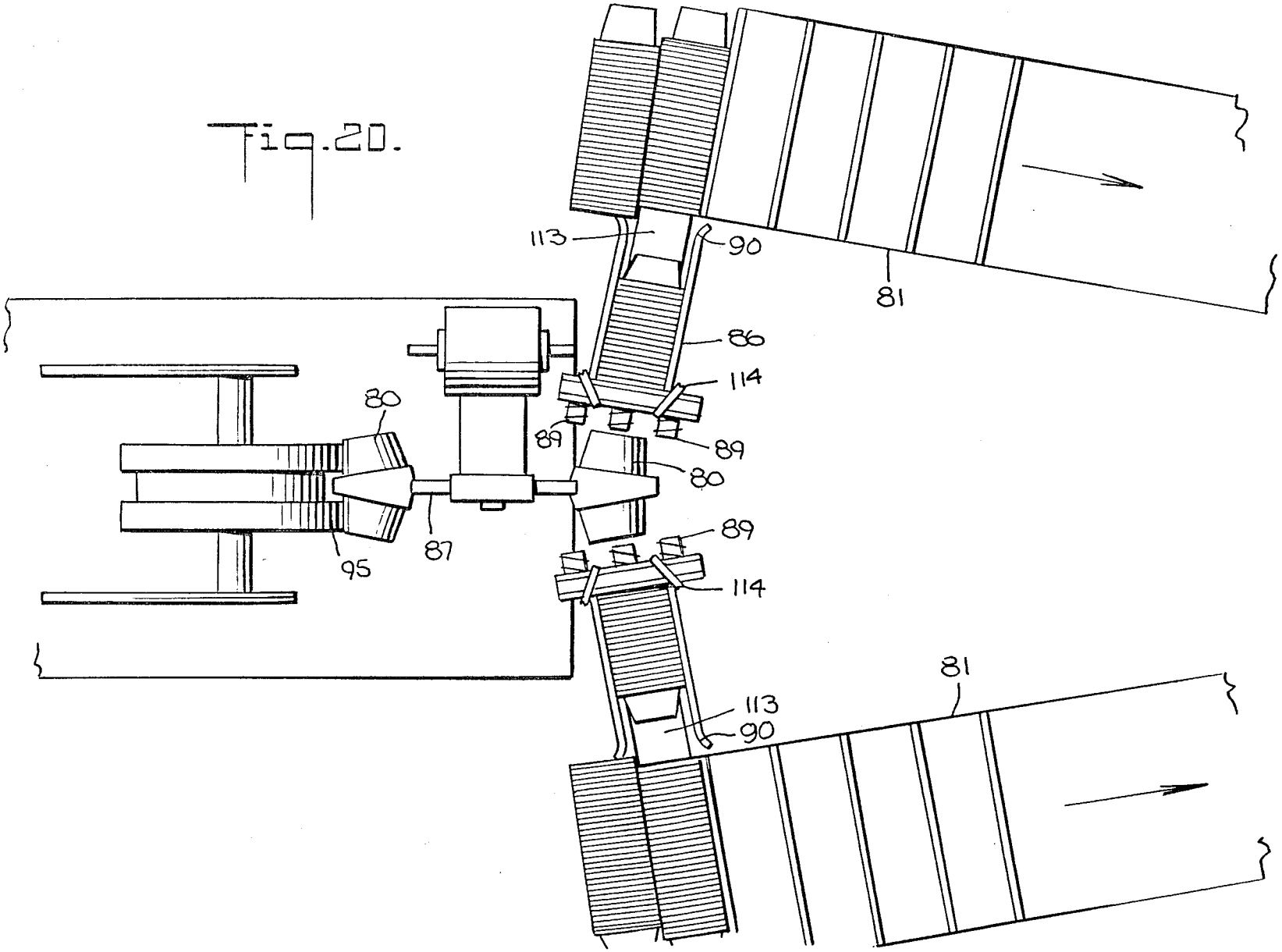
FIG. 20 is a diagrammatic plan view of the embodiment of FIG. 19.
Figure 21:
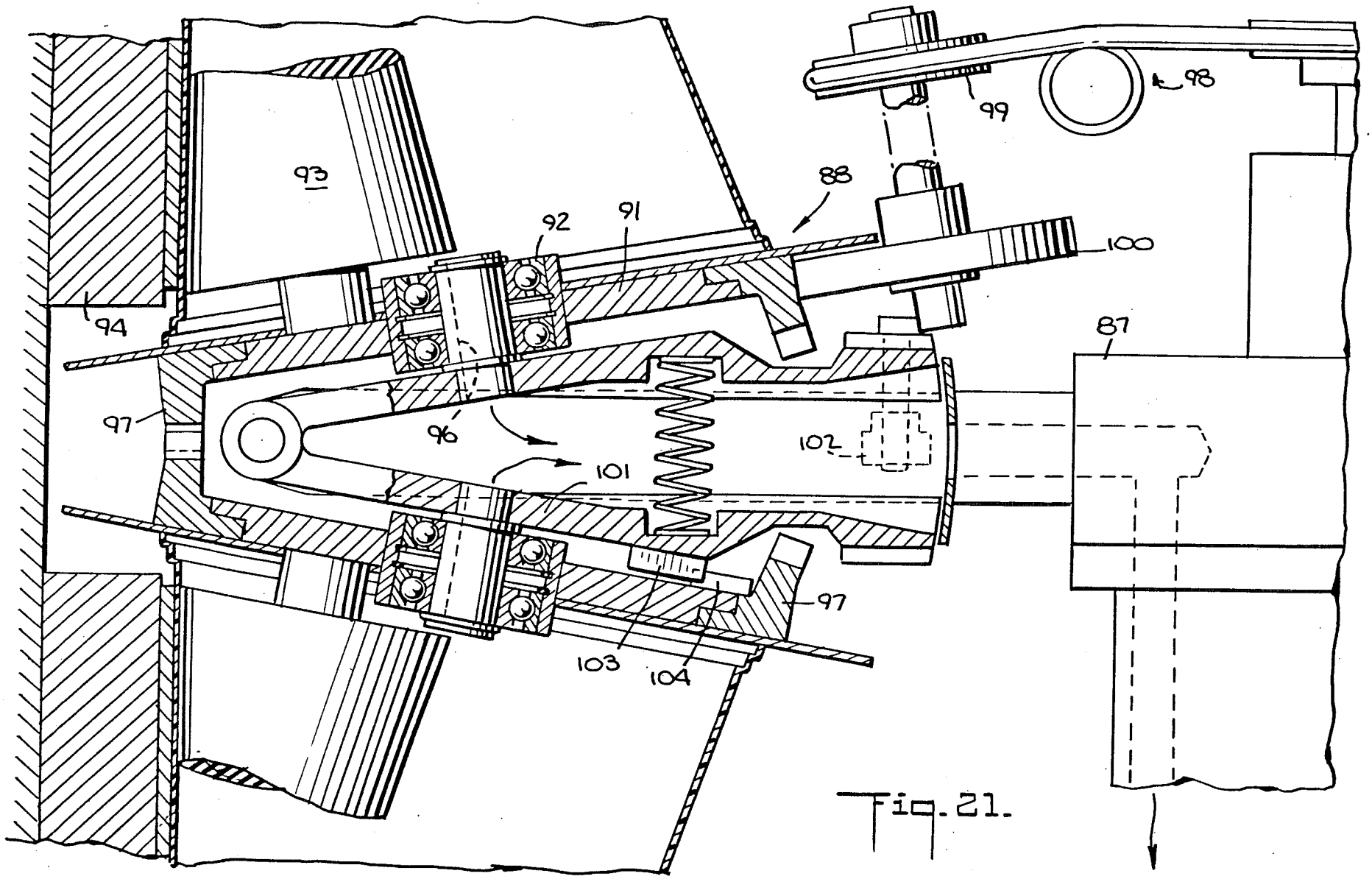
FIG. 21 is an enlarged horizontal sectional view of a preferred embodiment of a pair of container holders mounted on the printing disc.

FIGS. 19 through 21 illustrate another embodiment of the method and apparatus for printing containers. The first embodiment described above is directed to a method and an apparatus particularly adapted for printing box-like articles. This additional embodiment is adapted for printing tub-like or tray-like containers which are usually characterized by having sloping side walls such as the containers illustrated at 80 in FIGS. 19 through 21.

For the containers 80, a differing infeed device 79 as well as modified container holders are desirable.

FIG. 19 is a front elevational and diagrammatic view of an infeed system to feed the containers 80 at relatively high speed. An endless conveyor 81 is mounted on three appropriately spaced conveyor pulleys 82, 83 and 84. The conveyor 81 supports and advances a series of hollow compartments 85. Each of the compartments 85 contains a relatively deep stack of containers 80 such as several dozen containers loaded in each compartment. The conveyors 81 are periodically advanced by a suitable drive one compartment length to present a stack of the containers 80 at an infeed chute 86 which terminates at the printing disc 87. As is the case with the first embodiment, two identical infeed devices 79 are employed to feed the containers 80 to opposite sides of the printing disc 87. FIGS. 19 and 20 illustrate the right hand infeed system 79 and a similar but oppositely oriented feed system is used for feeding containers 80 to the opposite side of the printing disc 87. At the infeed transfer position the stacks of containers 80 are fed by a continuously moving belt 113, to the end of chute 86 where the endmost container 80 is fed from the end of the stack onto a container holder 88 on the printing disc 87 by four of helicoid drives 89 and air nozzles 114.

As will be more fully described in connection with FIG. 21, each container 80 is held in position on the container holder 88 by a vacuum force acting on the container 80 as it is advanced onto the container holder 88. This final transfer is controlled by the spaced helicoids 89. Periodically as a vacant compartment 85 is sensed by sensor 90, the conveyor 81 is stepped forward to present another container 80 stack to the chute 86 loading position.

FIG. 21 illustrates a preferred embodiment of the container holders 88 which are mounted around the outer edges of the printing disc 87 on opposite sides. Each of these holders 88 comprises a rotatably mounted hub 91 mounted on a central bearing 92. A tapered roller 93 is rotatably mounted on each hub 91 for engaging the container 80 side wall thereby facilitating the movement of the container when it is engaged by the printing blanket 94 at the printing station 95 such as the printing station described above for the first embodiment. In order to hold each container 80 tightly on the holders 88 for the several processing steps similar to those already described above, a vacuum is created within the container 80 by means of the conduit 96 passing into an air passage in the printing disc 87. The hubs are driven at the flame treating, registration and drying stations by a drive system 98 including ring gears 97 on each of the container holders 88 which interconnect facing holders 88 on opposite sides of the printing disc 87. FIG. 21 illustrates a belt driven drive system 98 coupled to a holder through the intermediation of belt 99 and pulley 100. To facilitate the printing of the tapering container 80 side surfaces by the relatively flat printing blankets 94, the hubs 91 are mounted at an angle to the plane of the printing disc 87 on pivotally mounted hub supports 101 whose exact angular position is adjusted at 102 for the amount of taper on the containers being printed. When extended to the printing positions latch members 103 and 104 on one ring gear 97 lock the hubs 91 against rotation.

When the printing disc 87 advances a printed container 80 to the takeoff station 110, the vacuum is released and the printed container is blown or otherwise ejected thru a suitable chute with the aid of hugger belts 112 to an empty compartment on the conveyor 81.

Processing stations similar to those described above for the first embodiment are used. These include the in-feed station 105, a flame treating station 106, registration stations 107 and 108, printing station 95, U.V. drying station 109, and the takeoff station 110.

It will be seen that an improved method and means have been described for printing containers and other boxes and particularly those with angularly aligned and relatively flat surfaces on which the labels and other decorations are printed. The method and machine are particularly adapted for performing this operation at a relatively high speed and with a plurality of feed lines so that two containers are being simultaneously processed at each of the several processing stations. The means for feeding the containers to and passing them through the processing steps including the printing step are particularly well adapted for handling box-like containers with carefully registered labels or other decorations.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A printer for the sidewalls of a hollow container comprising the combination of:

a container feed means for simultaneously presenting a plurality of containers to a transfer means;

a printing disc mounting a plurality of container holders on a circular array;

a resiliently mounted locking lever positioned on each of said container holders for holding said containers in their printing position;

transfer means for moving said plurality of containers from said feed means to said disc;

plurality of processinf stations positioned around the edge of said printing disc and adjacent to said holders;

one of said plurality of stations comprising a printer for printing the container sidewalls;

another of said plurality of stations comprising means for removing containers from said printing disc; and said locking levers comprising pivotally mounted levers with the levers on two back-to-back container holders on opposite faces of said printing disc being operatively coupled to a single spring loaded plunger.

2. The printer as claimed in claim 1 in which said container feed means comprises two feed chutes and said transfer means comprises two transfer members, said printing disc having processing stations mounted on opposite faces, and said transfer members being positioned for feeding the hollow containers onto said processing stations from said chutes in opposite directions.

3. The printer as claimed in claim 1 which further comprises means mounted on said printing disc for orienting the container holders in advance of said printing station and said container removal station.

4. The printer as claimed in claim 1 which further comprises a pair of pivotally mounted end plates adapted for being moved into engagement with a pair of containers on adjacent container holders at said printing station during the container printing.

5. The printer as claimed in claim 1 which further comprises means for exposing the printed containers to UV light at a station intermediate the container printing and the container removal stations.

6. The printer as claimed in claim 1 which further comprises belt driven means for rotating said container holders on said printing disc at a plurality of said stations.

7. The printer as claimed in claim 1 in which said station for printing container sidewalls comprises a printing blanket mounted for rotation and for driving engagement with the containers being printed.

8. A printer for the sidewalls of a hollow container comprising the combination of:

a container feed means for simultaneously presenting a plurality of containers to a transfer means;

a printing disc mounting a plurality of container holders in a circular array;

transfer means for moving said plurality of containers from said feed means to said disc;

a plurality of processing stations positioned around the edge of said printing disc and adjacent to said holders;

one of said plurality of stations comprising a printer for printing the container sidewalls;

another of said plurality of stations comprising means for removing containers from said printing disc;

each of said container holders comprising a rotatably mounted hub, an outwardly extending roll support mounted on the hub, and a roller rotatably mounted on the roll support for rollably engaging the container sidewalls during the printing of the container outer sidewalls;

and a second roller positioned at an outer end of said extending roll support for engaging the container bottom walls.

9. The printer as claimed in claim 8 in which said printing disc is mounted for rotation about a horizontal axis, said processing stations being equally spaced around the edge of said printing disc with equal numbers of processing stations on opposite faces of said disc, and the roller supports on the opposite disc faces being axially aligned.

* * * * *